US007857729B2

(12) United States Patent
Sullivan et al.

(10) Patent No.: US 7,857,729 B2
(45) Date of Patent: Dec. 28, 2010

(54) AUTOMATED STRIKING AND BLOCKING TRAINER WITH QUANTITATIVE FEEDBACK

(75) Inventors: Christopher P. Sullivan, Bridgeport, CT (US); Gregory Robert Sanderson, Fairfield, CT (US); Mike Swern, Jersey City, NJ (US); Glen T. Sergeant, Shelton, CT (US)

(73) Assignee: Fairfield University, Fairfield, CT (US)

( * ) Notice: Subject to any disclaimer, the term of this patent is extended or adjusted under 35 U.S.C. 154(b) by 0 days.

(21) Appl. No.: 12/486,376

(22) Filed: Jun. 17, 2009

(65) Prior Publication Data

US 2010/0130329 A1 May 27, 2010

Related U.S. Application Data

(60) Provisional application No. 61/073,167, filed on Jun. 17, 2008.

(51) Int. Cl.
*A63B 71/00* (2006.01)

(52) U.S. Cl. ..... 482/4; 482/1; 482/83; 482/84; 73/379.04

(58) Field of Classification Search ..... 482/1–9, 482/83–90, 900–902; 434/247; 73/12.01, 73/12.09, 379.04, 379.05
See application file for complete search history.

(56) References Cited

U.S. PATENT DOCUMENTS 4,088,315 A 5/1978 Schemmel
5,723,786 A * 3/1998 Klapman ..... 73/379.04
5,902,217 A 5/1999 Schechner et al.
6,110,079 A 8/2000 Luedke et al.
6,152,863 A 11/2000 Nelson et al.
6,416,445 B1 7/2002 Nelson et al.
7,308,818 B2 * 12/2007 Considine et al. ..... 73/12.09
2003/0216228 A1 * 11/2003 Rast ..... 482/84
2004/0176222 A1 9/2004 Mitchell
2004/0248633 A1 12/2004 Trawick et al.
2005/0209066 A1 9/2005 Penney
2006/0252608 A1 11/2006 Kang et al.
2006/0258515 A1 * 11/2006 Kang et al. ..... 482/83

* cited by examiner

*Primary Examiner*—Glenn Richman
(74) *Attorney, Agent, or Firm*—Wiggin and Dana LLP; Anthony P. Gangemi

(57) ABSTRACT

An automated striking and blocking trainer is disclosed. In some embodiments, the trainer includes the following: a frame; a striking body joined with the frame, the punching bag including one or more strike zone assemblies, the strike zone assemblies each having a light indicator and a striking force sensor; an arm assembly joined with the frame, the arm assembly including one or more arms, each of the one or more arms including a voltage differential sensor and a motion indicator in the form of an electrical motor, wherein the voltage differential between the power being used by the electrical motor when the one or more arms are not struck and when the one or more arms are struck is used to determine a torque of the one or more arms and an input force of a blocking strike; and a head assembly including a processor unit and a display.

9 Claims, 9 Drawing Sheets

AUTOMATED STRIKING AND BLOCKING TRAINER WITH QUANTITATIVE FEEDBACK

CROSS REFERENCE TO RELATED APPLICATION(S)

This application claims the benefit of U.S. Provisional Application No. 61/073,167, filed Jun. 17, 2008, which is incorporated by reference as if disclosed herein in its entirety.

BACKGROUND (1) Field

The disclosed subject matter generally relates to martial arts trainers. In particular, the disclosed subject matter is directed to an automated striking and blocking trainer with quantitative feedback.

(2) Description of the Related Art

Traditional martial arts training methods have relied heavily on the punching bag. Standard punching bags are simple. They consist of a sack, filled with some deformable yet resistant material, and kept aloft by a support structure. They are designed to receive the blows of a pugilist's assault without permanent deformation. However, punching bags are low-tech. The punching bag doesn't provide feedback to the user.

The traditional punching bag has a leather, canvas, or synthetic surface covering an interior bladder. This bladder is filled with either a synthetic material or grain to give the bag its shape and only allow for slight deformation upon impact. In this way the bag provides resistance without injuring the fighter's body. The bag is suspended from a system of hooks attached to a chain or ball bearing swivel. These bags come in two variations, the heavy bag and the speed bag. The speed bag is a lightweight ball shaped target that recoils easily and is used to increase the fighter's hand speed. The heavy bag is a large bag used to raise a fighter's strength and endurance. Unlike the speed bag, the size of the heavy bag and its resilience also makes it an effective target for kicks.

Outside of the western world, the martial artists of Asia and the Pacific Islands areas use martial arts training stands that are unique to the styles that spawned them. The Okinawan Makiwara is a tapered hardwood board varying in height and rigidity that is half buried in the ground, and the top portion is wrapped in hemp rope. One of the most interesting aspects of the Makiwara is that it returns to its original position after it is struck, immediately setting itself up for the fighter's next strike. Another martial arts tool is the Mok Yan Jong. Wooden "arms" are placed at the most common angles of an opponent's limbs and stick out from a central round wooden post "body." The "body" is attached to a support structure with flexible horizontal boards that simulate the resistance of a human opponent. As opposed to the heavy bag and the Makiwara, the Mok Yan Jong is used to condition a fighter's limbs and muscle speed to develop blocking technique.

Traditional training devices lack the ability to return quantifiable feedback. Currently, a user must rely on a partner or instructor to subjectively gauge any improvement in a fighter's speed, power, or reaction time. If sensing and recording elements were incorporated into a training bag, then the fighter would have quantifiable data that could be used to provide instantaneous feedback and be used to track progress over time. Used in conjunction with a digital display, this data would be provided back to the user in real time.

Traditional martial arts training methods have a limited amount of simulation. A heavy punching bag can simulate the weight of an opponent, and the Mok Yan Jong can simulate the points at which a fighter is most likely to strike. But there are never any variations in the interaction. It is difficult to create a true fight simulation without creating a physical human analogue. By breaking down the scenario of a stand up fight, two elements can be derived: moments when the fighter must defend and opportunities to attack.

There are various knows martial arts training devices. One device includes a traditional punching bag on a weighted stand on the ground. A standing bag is significant because it is the basic platform position for many of the products which are in direct competition. Another device uses LEDs for interaction, through the placement of light up scoring zones. In function, it works like a pugilistic version of Milton Bradley's Simon product. While this device does provide limited interaction, the user can only practice strikes, and not blocks. Additionally, it does not provide any form of quantifiable feedback.

One device attempts to provide some useful feedback. This device has a sensor imbedded within a striking surface that is then attached to a traditional punching bag. A wire harness runs from the sensor to a computation and digital display unit. It can provide reaction time calculations by emitting an audible tone and then tracking how long it takes for the fighter to hit the target. It also determines the accuracy of a strike by relating the strike to the center of the sensor pad. But there are problems with this system such as an inability to read the very small display, an exposed wire harnesses, limited striking area, durability issues, lack of force feedback, and keeping the striking surface fixed to one spot.

Another device that offers feedback information includes a sensor that connects to a computational unit with a wire harness. But unlike other known devices, the sensor can supposedly be placed anywhere on the bag. That is because the sensor is an accelerometer. The accelerometer is used to actually gage the force of a strike. But since the mass of the striking surface is unknown, actual force applied by the fighter to the striking surface cannot be given. Instead, the feedback given is a "score" which is related to the 'Gs' of acceleration seen by the sensor.

Known devices have various problems. First, the display on the many devices is very small, and could only be read by the fighter if they held it or stopped after each strike to read it. Second, glitches in the software cause the display to go blank, not record or save data, and not clear previous data when requested. The menus of many devices are not intuitive and even the instruction manual are often confusing. The sensor itself was occasionally limited in its ability to detect strikes. In devices that only employ one sensor, the manufacturers suggest that the user place the sensor at the top of the punching bag. The problem with this placement is that it understates the force of some strikes on the bag. Any strike outside a one square foot square area surrounding the sensor produces inconsistent results with similar strikes within the sensor zone. This makes the rest of the bag useless for recording data and limits the feedback abilities of such a device.

Another problem common to known devices is that they judge speed and reaction time by having the player hit the surface upon hearing an auditory beep. This misses the point of conditioning a fighter to react to visual stimuli, which is required during an actual fight. Repetitive training conditions a fighter's muscle and brain to react to visual stimuli. Many conditioned fighters have been recorded as having a reaction time (from visual stimuli to physical reaction) of a fifth of a second. Masters in the martial arts of been recorded at one twelfth of a second. Due to the slower speed of sound and the inherent differences in the brain's sensory of sound and vision, am auditory beep is not a reliable measure of the true reaction time of a fighter.

SUMMARY

An automated striking and blocking trainer is disclosed. Some embodiments of the trainer include the following: a frame; a striking body joined with the frame, the punching bag including one or more strike zone assemblies, the strike zone assemblies each having a light indicator and a striking force sensor; an arm assembly joined with the frame, the arm assembly including one or more arms, each of the one or more arms including a voltage differential sensor and a motion indicator in the form of an electrical motor, wherein the voltage differential between the power being used by the electrical motor when the one or more arms are not struck and when the one or more arms are struck is used to determine a torque of the one or more arms and an input force of a blocking strike; and a head assembly including a processor unit and a display, the processor unit being in electrical communication with the light indicator, the motion indicator, the striking force sensor, the voltage differential sensor, and the display.

A computer-readable medium having computer-executable instructions for training using an automated striking and blocking trainer is disclosed. In some embodiments, the instructions include the following: offering a selection of programs to initiate; gathering selection data input from a user; starting a particular program based on the selection data; proving a auditory and visual warning that the program is going to begin; beginning the program after a predetermined amount of time; proving a auditory and visual warning that the program has begun; starting a countdown timer; activating one or more of strike zone indicator lights or arm assemblies depending on instructions in the program selected; gathering data including one or more of strike forces, number of strikes, and number of blocks, wherein the voltage differential between the power being used by an electrical motor when one or more arms of the trainer are not struck and when the one or more arms are struck is used to determine a torque of the one or more arms and an input force of a blocking strike; proving a auditory and visual warning that the program has finished; performing calculations using the data gathered to generate a summary of the program; and presenting a visual display of the summary of the program.

BRIEF DESCRIPTION OF THE DRAWINGS

The drawings show embodiments of the disclosed subject matter for the purpose of illustrating the invention. However, it should be understood that the present application is not limited to the precise arrangements and instrumentalities shown in the drawings, wherein.

DETAILED DESCRIPTION

Figure 1:
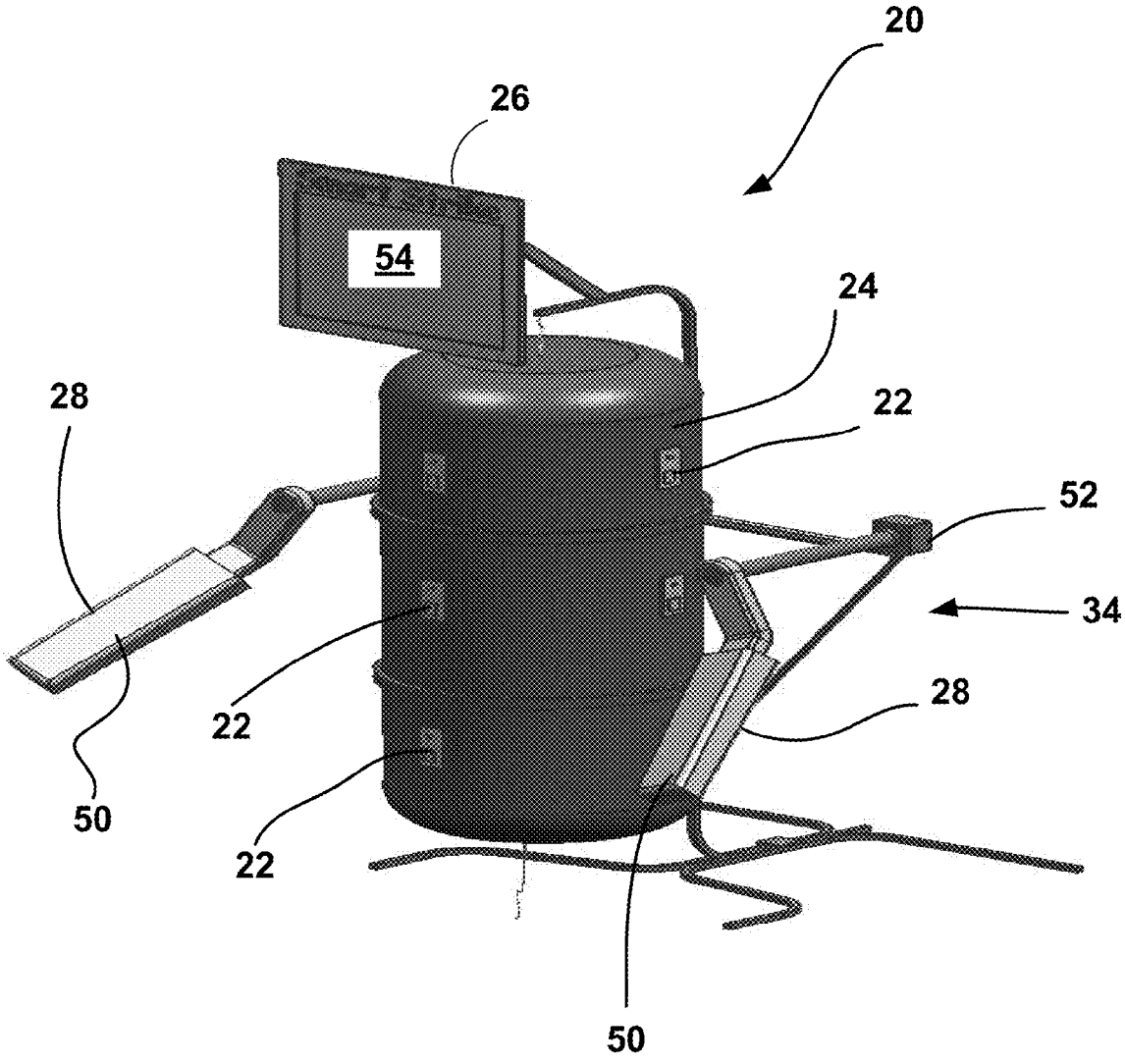
FIG. 1 is a front isometric view of a trainer according to some embodiments of the disclosed subject matter.

Referring now to the drawings in which like reference numerals indicate like parts, and in particular, to FIG. 1, one aspect of the disclosed subject matter is an automated striking and blocking trainer 20 (some embodiments are referred to as "Smart Strike" herein). Smart Strike is an automated martial arts trainer that provides an unprecedented level of interaction and useful feedback to the user. FIG. 1 shows one design of the trainer and related system. The Smart Strike gauges the force and reaction time of a fighter's strikes and blocks. Accelerometers 22 are used to measure the acceleration of the impact. These accelerometers 22 are mounted directly under a surface 24 of the striking surface. The accelerometers 22 will be encased to protect them from the impacts. There will be padding (not shown) between the sensor 22 and the impact surface 24 to protect the user from the sensor. This sensor data is sent to a processor which relays data back to the user through a display system 26 in real time. In addition, this data can later be downloaded to a personal computer for review. Through the use of interactive striking and blocking elements 28, Smart Strike runs programs that strengthen the fighter while increasing both his physical stamina and mental/muscle reaction time. The striking and blocking elements 28, combined with the sensors 22 and the data display 26, provide the user with unparalleled levels of feedback and interaction vital to martial arts training.

Figure 2:
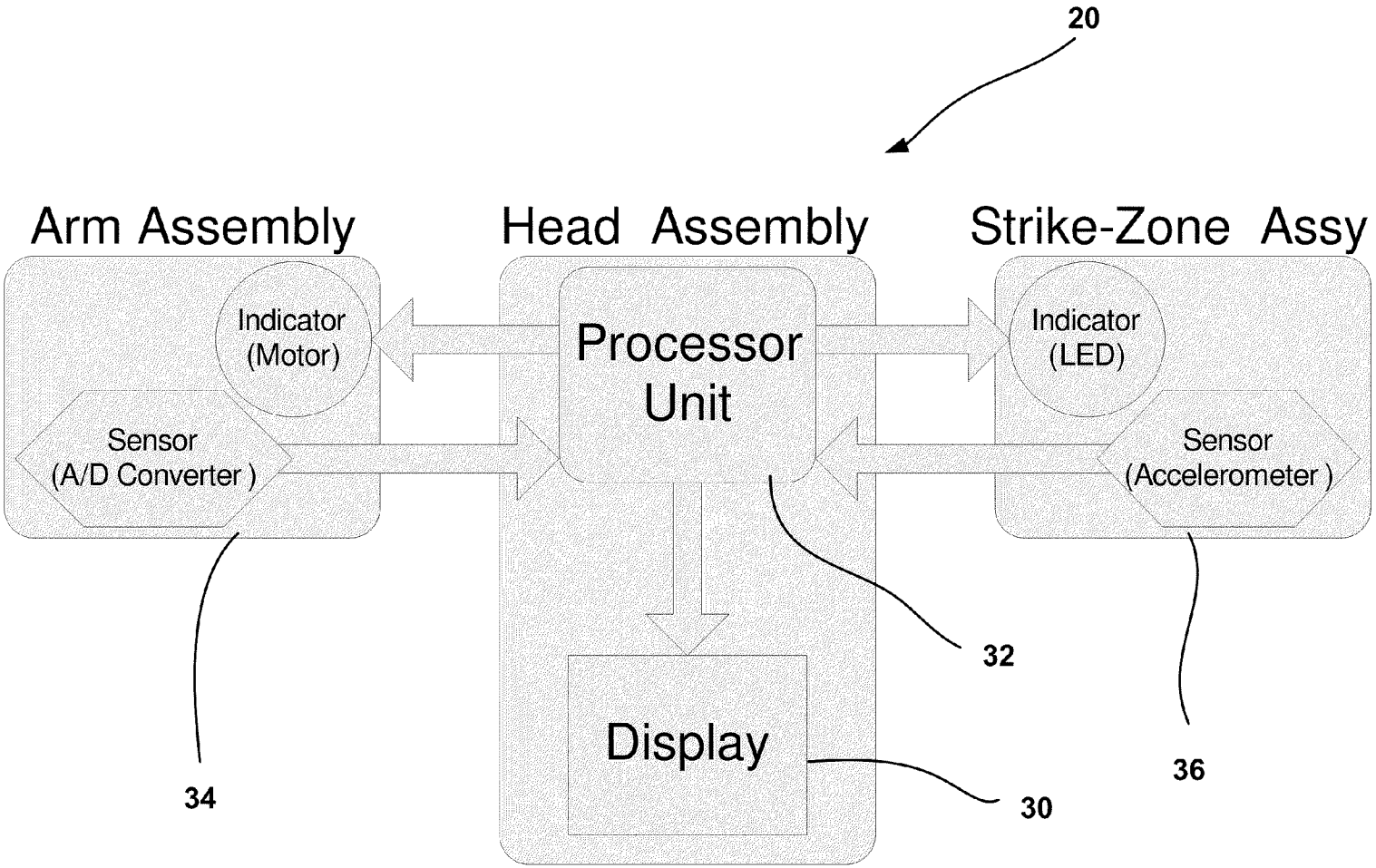
FIG. 2 is a schematic view of a trainer according to some embodiments of the disclosed subject matter.

Referring now to FIG. 2, some embodiments of the trainer 20 include four major components: (1) a display 30; (2) a processing unit 32; (3) an arm assembly 34; and (4) a strike-zone assembly 36. FIG. 2 shows how the different components communicate with each other.

Figure 3:
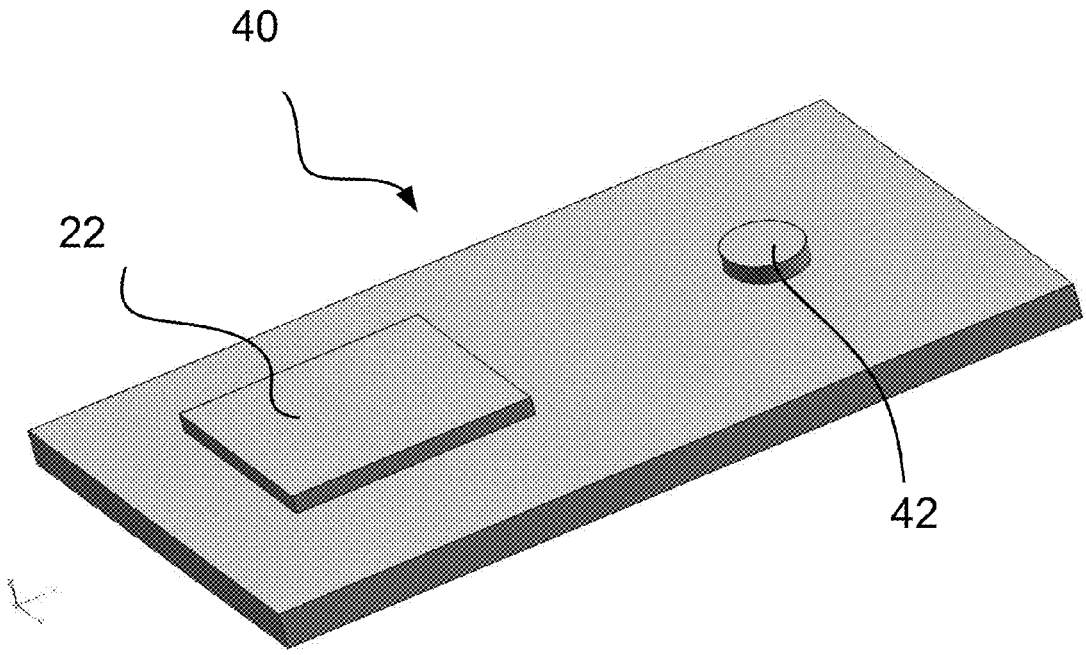
FIG. 3 is a front isometric view of a strike zone according to some embodiments of the disclosed subject matter.

Referring now to FIG. 3, the strike-zone assembly includes one or more Strike-Zone 40, each including an accelerometer 22 and an indicator 42. An accelerometer 22 detects external force upon the sensor and produces a change in output voltage. It is a solid state device that outputs a digital signal which is expressed as positive and negative g force along the axes of the device. The accelerometer 22 needs to be placed as close to the impact area as possible. The farther the accelerometer 22 is from the impact, the more dampening that will occur through the punching bag. For the Smart Strike trainer 20, the accelerometers 22 will typically be encased in a rigid polymer or similar to protect the wiring from repeated impacts. Directly under the exterior surface of the punching bag there will be an open-cell-foam layer or similar. There will be circular pockets in this foam layer that the accelerometer 22 will sit within. There will still be ½" of foam between the outer surface of the bag and the accelerometer 22. This will help protect the fighter from the hard accelerometer 22.

Multi-axis accelerometers 22 will be used in the Smart Strike 20. The axes that will be measured are 1) the axis going into the face of the punching bag, and 2) the axis going to the left and right of the punching bag. Since there will be minimal acceleration from the impact in the vertical axis, this axis will not be measured with the accelerometer. An accelerometer capable of reading 100 g in the direct punching axis and 50 g in the left and right axis will be used in the strike zone. This combination will be sufficient to cover the approximate 15 g of impact acceleration generated by even the average black belt karate pugilist.

The indicator light 42 on the strike zone 40 will prompt the fighter to hit that designated zone. Light Emitting Diodes, LEDs, or similar, will be used for the indicator lights 42. LEDs are rugged and will be able to withstand the abuse expected. As mentioned above, the LEDs will be surface mounted to the strike zone 40, with additional polycarbonate protection against abuse.

There will be multiple strike zones 40 on the Smart Strike trainer 20. In some embodiments of the Smart Strike trainer 20, the Strike-Zones 40 will be three layers of strike zones. This iteration will use a standard hanging bag. This bag will be able to rotate. Because of this rotation, the accelerometers 22 and indicator lights 42 will be arranged in a ring in the center of the strike zone layer. In some embodiments, there will be 4 accelerometers 22 spaced 90 degrees apart around the circumference of the zone. An array of 4 indicator lights 42 will encircle each accelerometer 22. By having many accelerometers 22, arranged in a ring, the fighter will always have an accelerometer within reach when the indicator lights 42 illuminate.

In some embodiments of the Smart Strike trainer 20, the striking surface 24 will be in the shape of a human torso with a head. On some embodiments, there will be 12 strike zones 40. These strike zones 40 will be clearly marked on the strike surface 24. These zones 40 will be: fore head, left side of head, right side of head, mouth, sternum (center of chest), left chest, right chest, top center of abdomen, right side of torso, left side of torso, lower left front of abdomen, and lower right front of abdomen.

The sway of the hanging bag version will have an impact on the accelerometer readings. In order to reduce the impact of this swaying, software will be used. This will be discussed more in the Processing Unit section. For the advanced model, the torso shaped striking surface will be mounted on a vertical member. This will not sway or rotate. However, even the quick bounce back on the rigid torso will have some impact on the accelerometer readings. This will also be compensated for with software.

Figure 4:
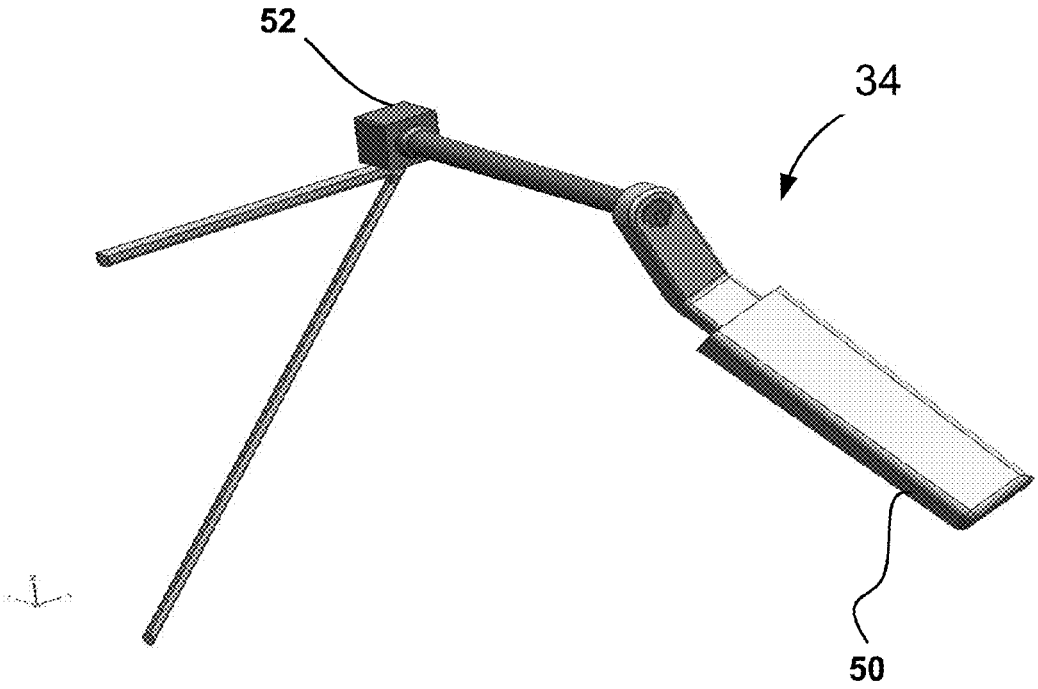
FIG. 4 is a front isometric view of an arm assembly according to some embodiments of the disclosed subject matter.

Referring now to FIG. 4, the arm assembly 34 includes arms 50 that present fighters with the most realistic combat simulation available. Motors 52 at the end of the blocking elements will be activated by the program. The motor 52 will engage, swinging the arm 50 at the fighter. The fighter will then either block the swing or the arm 50 will contact the fighter. If the fighter hits the arm 50, the impact will increase the electrical current draw on the motor. This increased load will be detected and the arm 50 will retract to its starting position. If the arm 50 hits the fighter, the motor will draw less current than if the fighter blocked it. A circuit will then be used to turn the current into a signal which can be interpreted by the analog to digital converters in the Processing Unit. This varying voltage will equate to the torque given by the user. Since the Smart Strike arm length is known, this torque can then be converted into input force. The system will record this as a hit or missed block.

The portion of the arm 50 that will contact the fighter will be padded for protection. This padding will swing in an arced path that will simulate the arm of an attacker. When the arms 50 are not moving they will be positioned with the padding as far away from the fighter as possible. This will reduce the chance that the arms 50 will be in the way of the fighter hitting the strike zones 40.

The structural elements supporting the padded arm 50 will generally be constructed of aluminum tubing, welded together to form a subassembly attached to the main bag frame. The arm 50 will then be padded with poly-filled vinyl inserts or similar to provide protection for the user against injury. Padding may be removed partially or completely to provide less protection for more experienced fighters.

The motor 52 for the arm assembly 34 will typically be geared for approximately 120 rpm. This will allow enough speed to test quick reactions, yet maximum speed will be attained quickly enough to provide stable output for accurate measurement.

Figure 5:
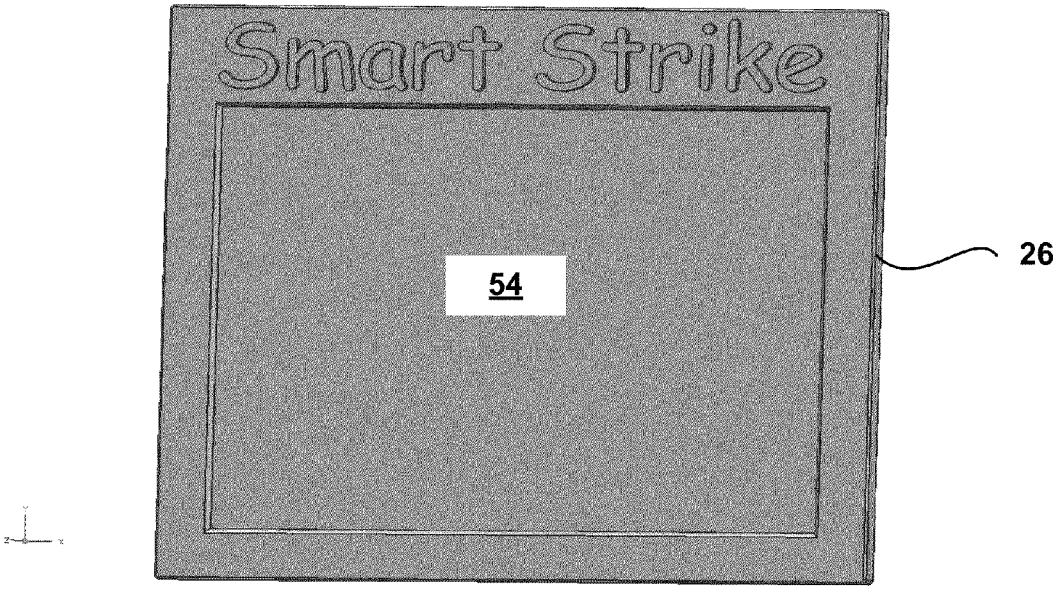
FIG. 5 is a front view of a display according to some embodiments of the disclosed subject matter.
Figure 6:
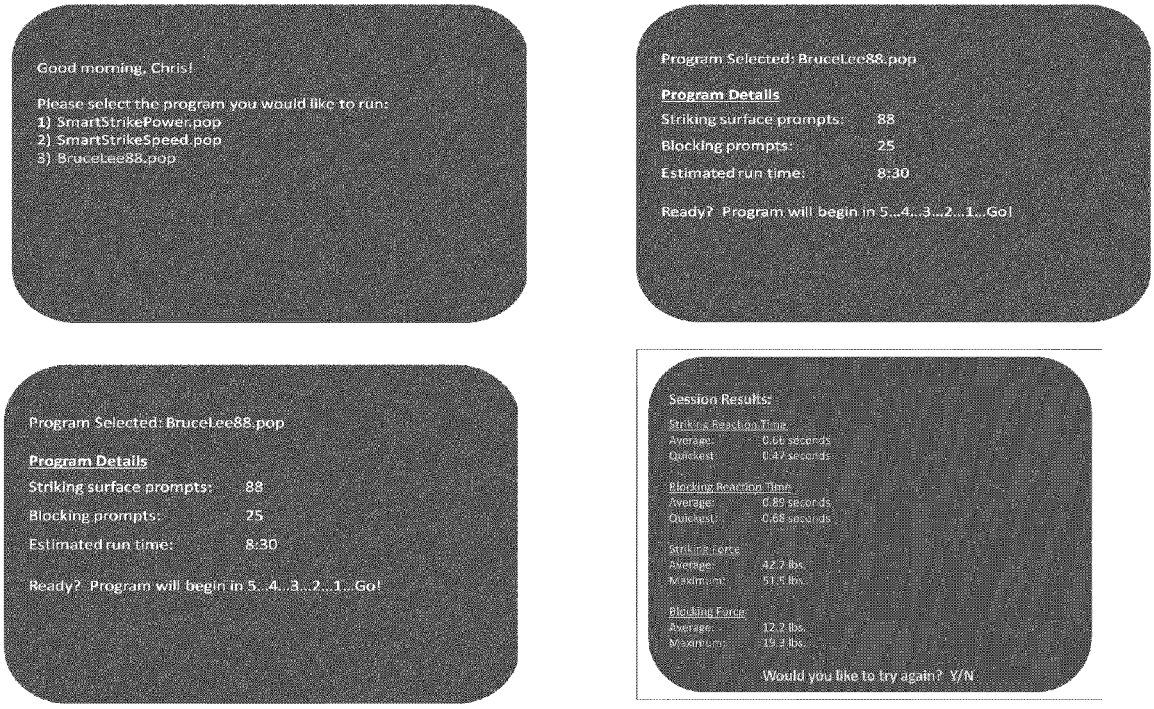
FIG. 6 includes screen shots of a program according to some embodiments of the disclosed subject matter.

Referring now to FIGS. 5 and 6, in some embodiments, the display 26 for the Smart Strike 20 will be a touch sensitive LCD display. This will allow fighters to make selections while wearing boxing gloves. A rugged display 26 will be mounted on an articulated arm (not shown) that will allow a user the ability to pull the display down to use the touch screen 54 and to move it back up, out of the way for training. This display 26 will be used to select the program to run. As shown in FIG. 6, when the program is selected, a summary of the training routine will appear. In addition, a count-down will be displayed and it will show the time remaining before the training starts. As the fighter is training, the force and reaction time will be displayed for each action, in real time. After the training session is complete, the user can then pull the display down to get a close look his result summary.

Processing unit 32 will typically store all of the loaded training programs. The unit 32 will translate the program into the correct sequence of indicator lamp illuminations and arm swings. When these actions are initiated, a timer is also started. The time between the initiation of the event and the response from the fighter is measured by the unit 32. The unit 32 will also take the data from the accelerometers 22 and detect the amperage load on the motor 52. In addition, the processing unit 32 will typically be equipped with a USB port or other ports for transferring data to a personal computing device.

The Smart Strike Processing Unit 20 will typically come with standard training programs installed. The user will be able to download new training programs from a website. Typically, the user will use a USB device to transfer these programs from the website to the processing unit or via a wireless network connection. In addition, the user can transfer performance results from the processing unit 32 to a personal computing device via the USB device or via a wireless network. This data can then be put on a website to track a user's progress over time.

The accelerometers 22 are connected to the Processing Unit 32. They are constantly streaming data for all axes to the Processing Unit 32 while a program is running. This data is associated with specific Strike-Zones 40. When the striking surface 24 is hit, all the accelerometers 22 register an impact. This data is interpreted by the unit 32 to indicate the closest accelerometer 22 that was impacted. The data for both axes are resolved to give a single resultant acceleration value. To improve the accuracy of the data associated with a hit, the software that receives the accelerometer data uses a threshold range to prevent the unit 32 from interpreting noise from the recoil and sway of the striking surface 24 as impacts from the fighter. The threshold is a magnitude of acceleration of which, once exceeded the program knows that it is important data. For example, the threshold might be set at 1 g. Not until the accelerometer 22 generates a reading of greater than 1 g does the Processing Unit 32 count the impact as a strike. In addition, the use of direction on the accelerometers 22 helps to eliminate the acceleration of the bag returning towards the fighter. This swaying will have a negative acceleration. Impacts from the fighter going directly into the striking surface 24 will have a positive acceleration. The software also uses the data from all of the accelerometers 22 to ignore non-impact data. If all accelerometers 22 are showing similar acceleration data, it can be assumed that this acceleration is not due to an impact, but is due to the sway or recoil of the punching bag.

To simplify the displayed values for the user, the acceleration values are converted to force, since mass of the striking surface 24 is known and the accelerometers 22 provides the acceleration data. The acceleration values resolved from the two axes are used to calculate the force value.

Referring now to FIGS. 7-11, other aspects of the disclosed subject matter are methods and systems for training with a trainer designed according to the disclosed subject matter. In some embodiments, there will be one main program which calls on various subroutines that accomplish the objectives described in the Strike-Zone section. The integration of these various components results in the Smart Strike system 20. The methods show in FIGS. 7-11 will typically be embodied in a computer-readable medium having computer-executable instructions, i.e., a software program.

Figure 7:
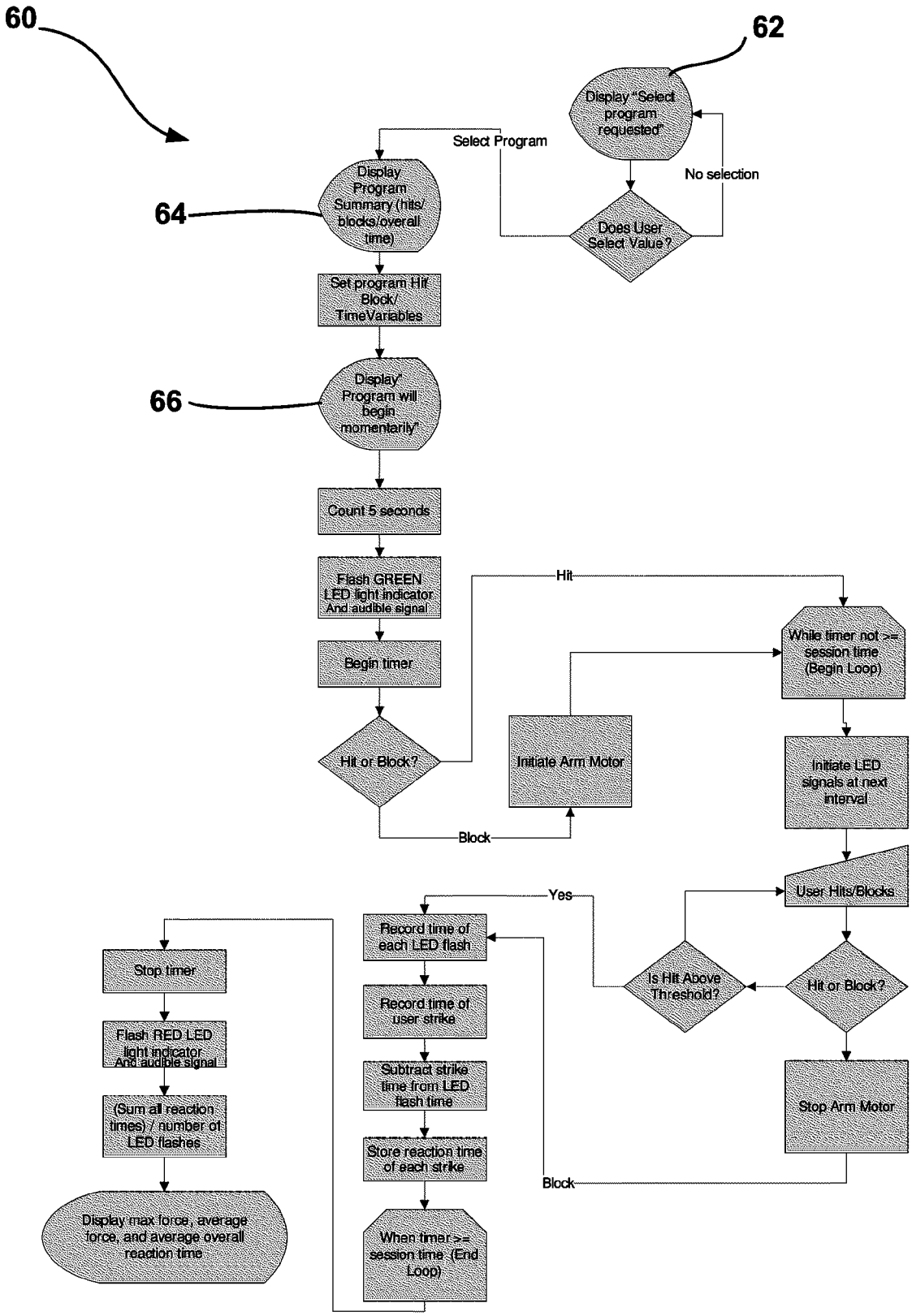
FIG. 7 is a diagram of a method according to some embodiments of the disclosed subject matter.

As shown in FIG. 7, the user typically begins their workout on the Smart Strike system 20 by initiating a software program, which includes a method 60. This action will call the main program. At 62, the user will then be prompted to choose the program they wish to initiate. These programs will consist of various Strike-zone signals, and Arm motor signals. At 64, for each program, the user will be prompted with an overview of the program's training content, and at 66, a warning that the session is about to begin. An audible sound will signal the beginning and ending of a session.

Figure 8:
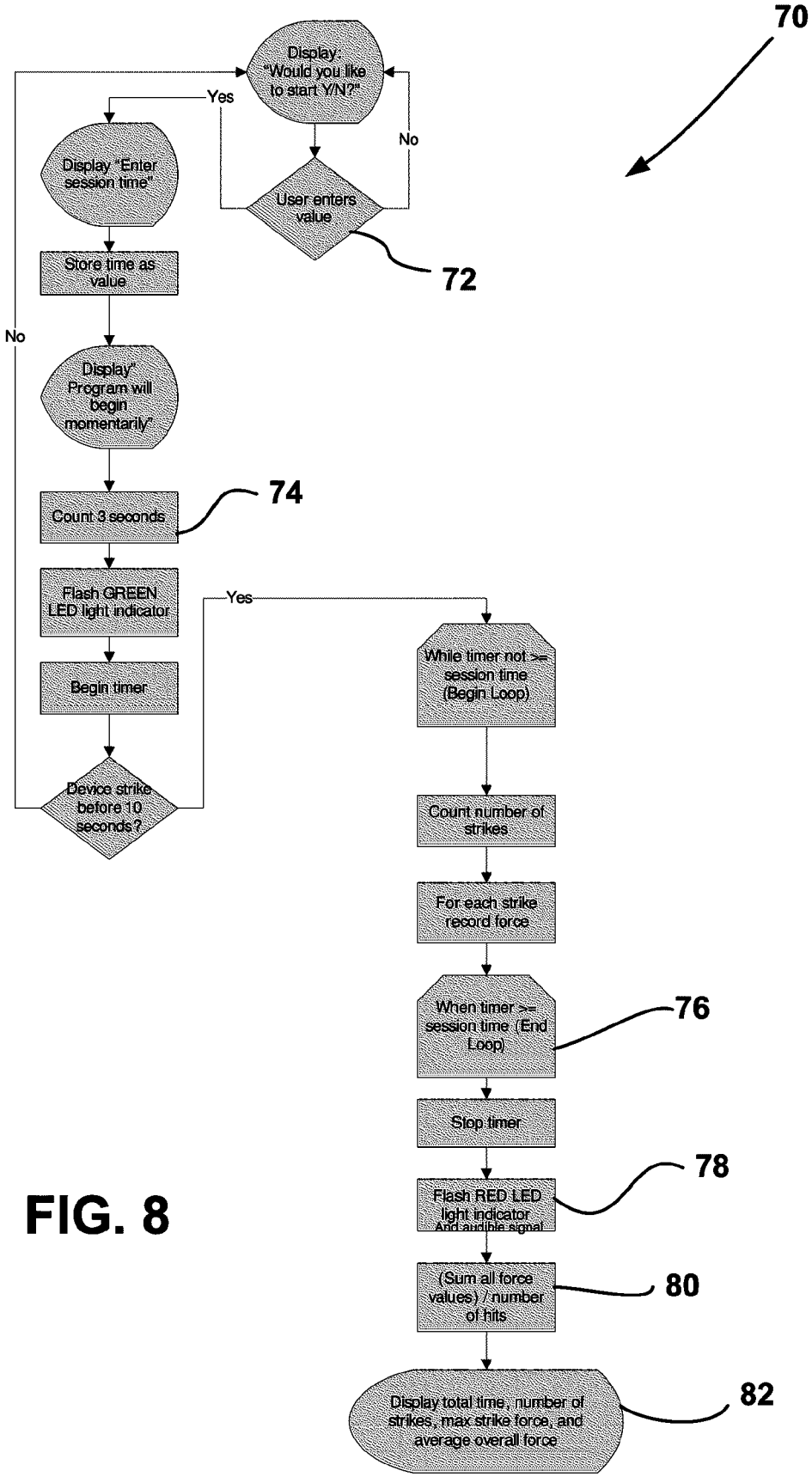
FIG. 8 is a diagram of a method according to some embodiments of the disclosed subject matter.

Another type of program will be a free-style type training scenario. Referring to FIG. 8, method 70 includes instructions in which the Smart Strike system 20 will not prompt specific target areas, but will record impact force and frequency for a predetermined amount of time, which is entered at 72. If the user chooses the free-style training program, at 74, the display begins to count down and the training period begins. This alerts the fighter to begin striking the device. The user then advances through the routine by striking the device as many times as he or she would like before the session time expires. Accelerometer sensors 22 within the Strike-Zones 40 send the strike data back to the Processing Unit 32. When the session time expires at 76, an audible sound will signal the end of the session at 78. At 80, the program will then compute the total number of strikes, the average time between strikes, the average force of those strikes (sum of all forces divided by total strikes), and the maximum force recorded of all strikes. At 82, this data, along with the session time, will be displayed for the user.

Figure 9:
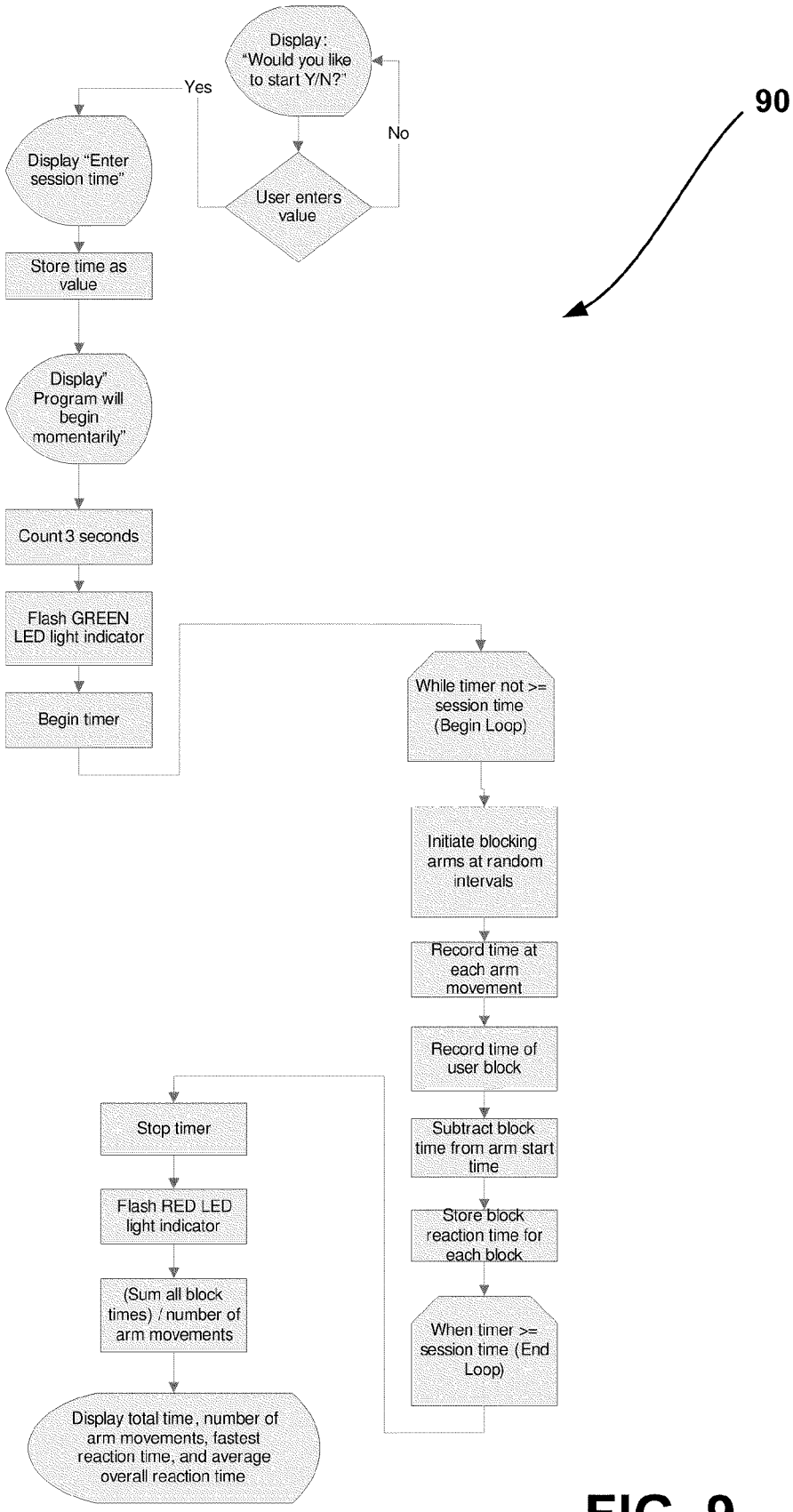
FIG. 9 is a diagram of a method according to some embodiments of the disclosed subject matter.
Figure 10:
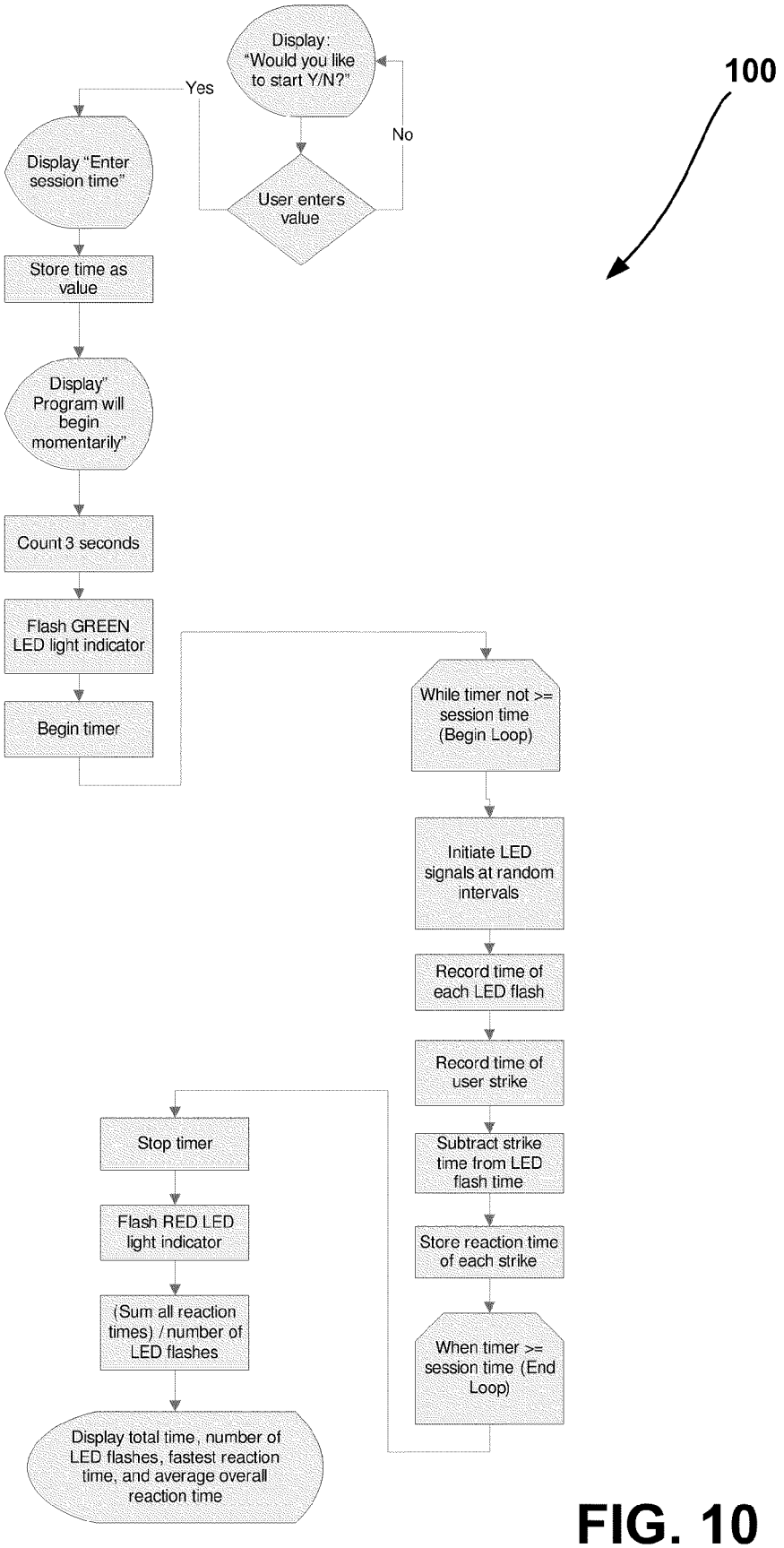
FIG. 10 is a diagram of a method according to some embodiments of the disclosed subject matter.
Figure 11:
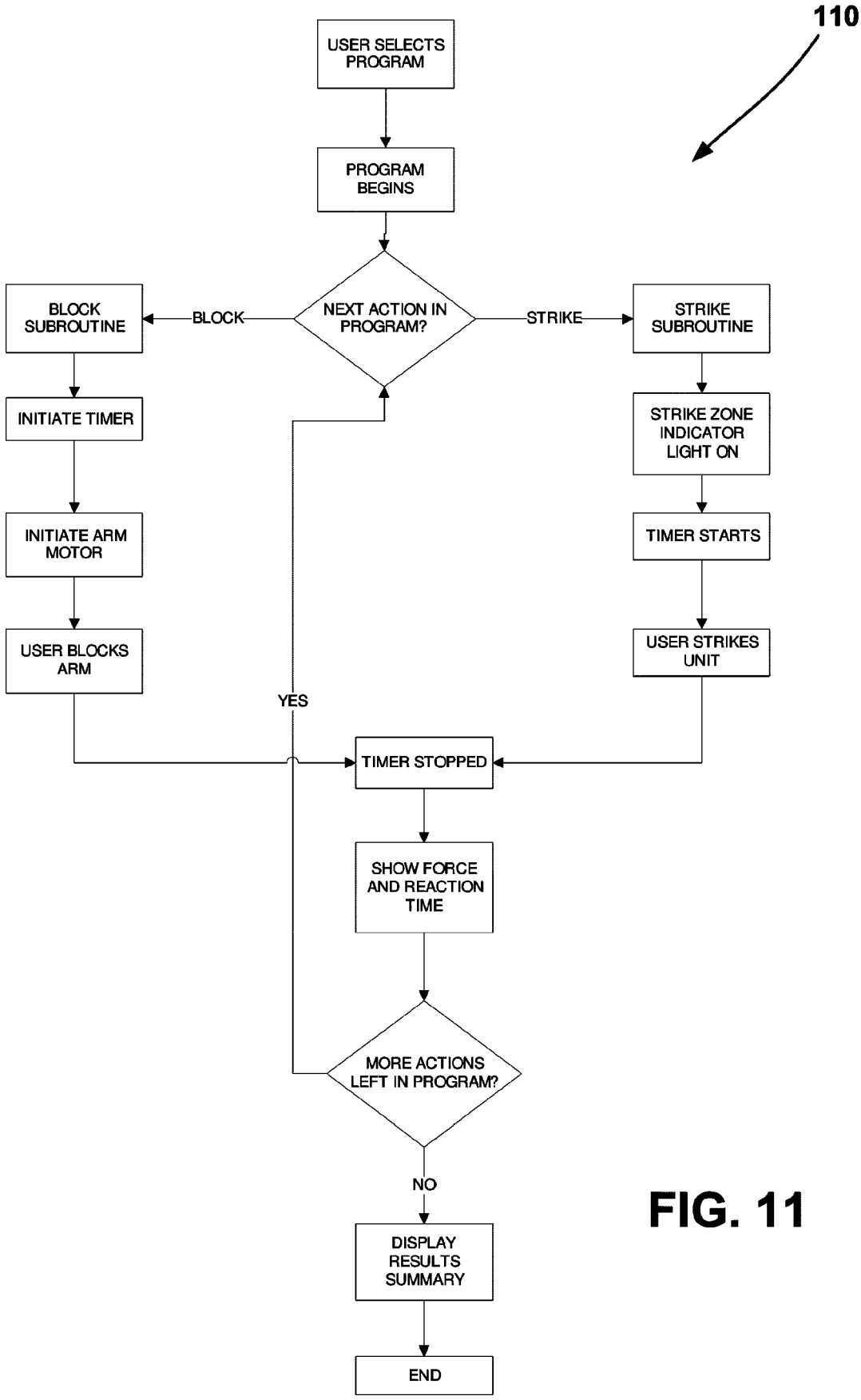
FIG. 11 is a diagram of a method according to some embodiments of the disclosed subject matter.

Referring now to FIG. 9, in some embodiments, a method 90 includes a method similar to that of method 70, with one exception being that blocks are measured over a pre-set interval of time rather than strikes. Referring not to FIG. 10, in some embodiments, a method 100 includes a method similar to that of method 70 and 90, with one exception being that the reaction time to strike a strike zone 40 is measured from the time each indicator light 42 is activated until the user strikes the strike zone. FIG. 11 shows a method 110, which is a general program that can be used for both striking and blocking training in a trainer 20.

In additional embodiments, it is envisioned that through the Smart Strike website, users will have the ability to generate striking and blocking scenarios and download them to the Smart Strike device via the USB connection. In addition, a website will be available for users to post their scenarios on the website for others to use and to download other users' scenarios for their own use. For standard Smart Strike programs there will be leader boards where athletes can post their performance scores. There will also be Smart Strike brand training programs available for a fee.

The disclosed subject matter offers advantages over known methods and systems. It provides feedback and interaction in training equipment to revolutionize speed, power, and reaction time in the Martial Arts.

Smart Strike is a tool that will mark a significant departure from the training options currently available to the martial artist. The unprecedented opportunity for feedback information and interaction with the system differs from other methods to such a significant degree that only "revolutionize" would properly describe the change. Speed, power, stamina, and reaction time are the physical and mental conditioning elements needed by a successful fighter. Smart Strike will provide useful feedback regarding all of those elements for both offensive strikes and defensive blocks. These strikes and blocks will be guided by a user-selected program on the Smart Strike device. This data is relayed back to the user through a display system in real time and can later be downloaded to a personal computer for review. The title of Martial Arts was chosen because students of a wide variety of disciplines, both Western and Eastern, will find Smart Strike to be an indispensable addition to their traditional training equipment.

There is an opportunity to provide a product to the martial arts and sports equipment markets that does not exist today. That product is a training device that can provide valuable information and automated interaction for its user. By incorporating sensing and recording elements into a traditional style punching bag the user can have quantifiable data delivered instantaneously and that data can also be stored over time to track progress. The Smart Strike integrates these features in terms of force and reaction time in addition to offering an automated blocking mechanism that will allow the user to practice offensive and defensive maneuvers simultaneously. Users will also be able to access training programs on-line, share their own programs with other users, and compare their results with those of peers.

The Smart Strike device offers significant features beyond what a traditional punching bag can offer. The striking surface will be equipped with sensors that provide the user with feedback on the force of his or her strikes. Beyond displaying the force values in real time, the user, at the end of a session, will also be able to ascertain the average, maximum and minimum force values. Users of the device will also be able to test their strike reaction time. To determine this data the user will be prompted with a series of visual signals alerting him or her to strike the surface. The sensors will pick up the strikes and the user can get information such as average, fastest, and slowest reaction time.

The Smart Strike device includes a unique arm attachment that will allow the user to practice blocking techniques. The motorized arm will swing in an arc, thus replicating the action of an assailant's strikes. The goal of this feature is to enable the user to practice defensive and offensive maneuvers simultaneously. Sensors will be attached to the arm so that, similar to the striking surface, users can get feedback on blocking force and reaction time.

Other aspects of the disclosed subject matter includes a software program that can be installed on a personal computer and interact with the device by way of USB ports outfitted on the equipment. This software program will be used to store a user's data over time and provide an interactive way for the user to track progress. The user will also be able to design practice routines that can be downloaded to the device. A web site will also be established that offers advice, instructions, and general features such as blogs and discussion boards. Here users will also be able to share training programs and compare their results with those of their peers.

Martial artists, boxers, or general fitness enthusiasts can all benefit from the Smart Strike product. They can practice multiple striking techniques such as punching, kicking, kneeing, elbowing, etc. since a sizeable heavy bag will be employed. Having an arm that simulates an opponent's movements offers the benefit of being able to practice offense and defense at the same time. Receiving force and reaction time feedback offers the benefit of real-time, quantifiable data and it is important to be able to track progress in these two areas over time. Continuous use of the device will improve strength, stamina, and quickness.

Smart Strike also offers general fitness benefits, such as aerobic training, muscle toning and improvements to reflexes and coordination. Using Smart Strike regularly can also lead to weight loss, which is important considering how obesity rates and other health problems such as heart disease and diabetes are on the rise. For children, this product can also help in a number of ways. Children with ADHD can use the device as an outlet for excess energy. Learning how to strike and defend one's self can also be effective in countering bullies. Furthermore, these benefits—being in shape, weight loss, improving skills, self defense—all promote self-esteem.

Although the disclosed subject matter has been described and illustrated with respect to embodiments thereof, it should be understood by those skilled in the art that features of the disclosed embodiments can be combined, rearranged, etc., to produce additional embodiments within the scope of the invention, and that various other changes, omissions, and additions may be made therein and thereto, without parting from the spirit and scope of the present invention.

What is claimed is:

1. An automated striking and blocking trainer, said trainer comprising:

a frame;

a striking body joined with said frame, said punching bag including one or more strike zone assemblies, said strike zone assemblies each having a light indicator and a striking force sensor;

an arm assembly joined with said frame, said arm assembly including one or more arms, each of said one or more arms including a voltage differential sensor and a motion indicator in the form of an electrical motor, wherein the voltage differential between the power being used by said electrical motor when said one or more arms are not struck and when said one or more arms are struck is used to determine a torque of said one or more arms and an input force of a blocking strike; and a head assembly including a processor unit and a display, said processor unit being in electrical communication with said light indicator, said motion indicator, said striking force sensor, said voltage differential sensor, and said display.

2. A trainer according to claim 1, wherein said light indicator is formed from a light emitting diode.

3. A trainer according to claim 1, wherein said striking force sensor is an accelerometer.

4. A trainer according to claim 1, wherein said striking body is a punching bag.

5. A trainer according to claim 1, wherein said display includes a touch screen.

6. A computer-readable medium having computer-executable instructions for training using an automated striking and blocking trainer, said instructions comprising:

offering a selection of programs to initiate;

gathering selection data input from a user;

starting a particular program based on said selection data;

proving a auditory and visual warning that said program is going to begin;

beginning said program after a predetermined amount of time;

proving a auditory and visual warning that said program has begun;

starting a countdown timer;

activating one or more of strike zone indicator lights or arm assemblies of said automated striking and blocking trainer depending on instructions in said program selected;

gathering data including one or more of strike forces, number of strikes, and number of blocks, wherein the voltage differential between the power being used by an electrical motor when one or more arms of said trainer are not struck and when said one or more arms are struck is used to determine a torque of said one or more arms and an input force of a blocking strike;

proving a auditory and visual warning that said program has finished;

performing calculations using said data gathered to generate a summary of said program; and presenting a visual display of said summary of said program.

7. A computer-readable medium according to claim 6, wherein said summary includes one or more of a total number of strikes, an average time between strikes, an average force of those strikes that is equal to a sum of all forces divided by total strikes, a maximum force recorded of all strikes, punch count, punch speed, punch accuracy, punch power, and trend data over the duration of a workout for data included in said summary.

8. A computer-readable medium according to claim 6, wherein said program includes one of gathering data related to both blocking and striking over a predetermined amount of time, gathering data related to blocking over a predetermined amount of time, gathering data related to striking over a predetermined amount of time, and gathering data related to reaction time and striking over a predetermined amount of time.

9. A computer-readable medium according to claim 6, wherein said instructions are executed by multiple users via an Internet connection.

* * * * *